US009586786B2

(12) United States Patent
Lehtinen

(10) Patent No.: US 9,586,786 B2
(45) Date of Patent: Mar. 7, 2017

(54) ROPE STORAGE UNIT AND METHOD FOR INSTALLING ELEVATOR ROPES

(71) Applicant: Hannu Lehtinen, Numminen (FI)

(72) Inventor: Hannu Lehtinen, Numminen (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 14/941,828

(22) Filed: Nov. 16, 2015

(65) Prior Publication Data

US 2016/0176675 A1 Jun. 23, 2016

(30) Foreign Application Priority Data

Dec. 17, 2014 (EP) ..... 14198544

(51) Int. Cl.

| | |
|---|---|
| ***B65H 75/16*** | (2006.01) |
| ***B66B 19/00*** | (2006.01) |
| ***B66B 19/02*** | (2006.01) |
| ***B66B 7/06*** | (2006.01) |

(52) U.S. Cl.

CPC ..... *B65H 75/16* (2013.01); *B66B 7/062* (2013.01); *B66B 19/007* (2013.01); *B66B 19/02* (2013.01); *B65H 2701/35* (2013.01)

(58) Field of Classification Search

CPC .... B65H 75/16; B65H 2701/35; B66B 7/062; B66B 19/007; B66B 19/02

USPC ..... 187/414

See application file for complete search history.

(56) References Cited

U.S. PATENT DOCUMENTS 4,244,536 A * 1/1981 Harrill ..... B65H 75/40 191/12.2 R
4,282,954 A * 8/1981 Hill ..... H02G 11/02 191/12.4
4,429,839 A * 2/1984 Jessamine ..... B63B 35/816 114/254
4,706,843 A * 11/1987 Thornton ..... A01K 89/00 132/321

(Continued)

FOREIGN PATENT DOCUMENTS

EP 0959035 A2 11/1999
GB 1312489 A 4/1973

(Continued)

*Primary Examiner* — Michael Riegelman

(74) *Attorney, Agent, or Firm* — Harness, Dickey & Pierce, P.L.C.

(57) ABSTRACT

The invention relates to a rope storage unit, comprising a rope reel, formed by a rope wound in a spiral form and having a central axis, and delimiting a central space inside the rope reel, the rope having an end protruding from the inner rim of the rope reel; and a support body provided with an inner space inside which the rope reel is positioned, the support body comprising a side face plate, which side face plate delimits the inner space in axial direction of the rope reel and comprises an opening extending through it; and a guide collar for guiding the rope end away from the central space without contacting the side face plate, which guide collar is mounted on the side plate and borders the opening thereof, the guide collar delimiting a guide opening that leads away from the central space of the rope reel. The invention relates to a method for installing an elevator rope implementing said rope storage unit.

16 Claims, 5 Drawing Sheets

(56) References Cited

U.S. PATENT DOCUMENTS

| | | | | |
|---|---|---|---|---|
| 7,198,151 | B1 * | 4/2007 | Fomby | A45C 5/08 206/303 |
| 8,770,438 | B2 * | 7/2014 | Cahill | E05B 75/005 221/191 |
| 2009/0114483 | A1 * | 5/2009 | Korkeakangas | B66B 19/02 187/266 |
| 2014/0004298 | A1 | 1/2014 | Reif et al. | |
| 2015/0060588 | A1 * | 3/2015 | Lehtinen | B65H 75/16 242/407 |

FOREIGN PATENT DOCUMENTS

| | | | |
|---|---|---|---|
| WO | WO-2009090299 | A1 | 7/2009 |
| WO | WO-2013041771 | A1 | 3/2013 |

* cited by examiner

ROPE STORAGE UNIT AND METHOD FOR INSTALLING ELEVATOR ROPES

This application claims priority to European Patent Application No. EP14198544.0 filed on Dec. 17, 2014, the entire contents of which are incorporated herein by reference.

FIELD OF THE INVENTION

The invention relates to storing and installing of one or more elevator ropes. The rope is, in particular, a rope for an elevator meant for transporting passengers and/or goods. The rope may be a suspension rope for suspending the elevator car, for instance.

BACKGROUND OF THE INVENTION

Storing of a rope may be needed in various stages of its lifetime. The storing is conventionally implemented by forming a rope reel of the rope so that it can be stored and/or transported as a compact unit. In the field of elevators, storing is usually needed for transporting the rope to the site, and further to the specific installation location where the rope can be unwound and installed in the elevator.

Ropes are typically irreversibly flexible such that after bending the rope into a curve, it does not reverse back to its original form by itself. These kinds of ropes usually comprise load bearing members made of twisted wires or equivalents. This kind of rope is easy to wind around a drum where it can be stored until a later unwinding. Also such ropes exist, which are rod-like and have a straight form when in rest state. This type of rope is presented in patent publication WO2009090299 A1. This type of ropes are relatively rigid, but elastically bendable, and the rope self-reverses back to a straight form from bent form in rest state, i.e. after all bending directed to it ceases. A known way to store this kind of ropes has been to form a rope reel from the rope by winding it around a drum and subsequently tying the rope end against the outer rim of the rope reel so that the rope reel cannot unwind.

The known methods described above have caused difficulties in later unwinding process. In particular, after releasing the rope end, the rope end has been difficult to control. This has been the case particularly with ropes that are elastically bendable and tending to reverse towards straight form after bending. It has been found out that the bending tension is prone to cause difficulties in unwinding of the rope the more rigid the elastically bendable ropes are. The rope tends to straighten as an effect of said bending tension and may easily escape from the hands of the person preparing the unwinding operation. Avoiding this type of events has necessitated auxiliary means or personnel for controlling the rope end once it has been freed from the reel.

BRIEF DESCRIPTION OF THE INVENTION

The object of the invention is to introduce an improved rope storage unit and an improved method for installing of an elevator rope. An object is, more particularly, to introduce a rope storage unit wherein rope can be stored and wherefrom it can be subsequently unwound without damaging it, all this in a simple and efficient way. Further, an object is to introduce a method for installing of an elevator rope, which is simple to carry out and does not jeopardize condition of the ropes. The object is particularly to introduce a rope storage unit and a method well suitable for a rope, which is elastically bendable and thereby difficult to handle. With the invention, inter alia, one or more of the previously described drawbacks of known solutions and problems discussed later in the description of the invention, can be alleviated. Advantageous embodiments are presented, inter alia, which are well suitable for a rope having sensitive surface material.

It is brought forward a new rope storage unit, comprising a rope reel, formed by a rope wound in a spiral form and having a central axis, and delimiting a central space inside the rope reel, the rope having an end protruding from the inner rim of the rope reel; and a support body provided with an inner space inside which the rope reel is positioned, the support body comprising a side face plate, which side face plate delimits the inner space in axial direction of the rope reel and comprises an opening extending through it; and a guide collar for guiding the rope end away from the central space without contacting the side face plate, which guide collar is mounted on the side plate and borders the opening thereof, the guide collar delimiting a guide opening that leads away from the central space of the rope reel. Hereby, it is provided that the rope is unwindable by moving rope away from the rope reel via said central space and through the opening of the guide collar such that it slides against the surface of the collar. With this configuration, the rope can be stored in a controlled and efficient fashion as well as subsequently unwinded both in a controlled and gentle fashion without touching the side plate. The rope storage unit defined is well suitable for a rope which is elastically bendable and thereby difficult to handle during unwinding process. The gentleness of the guidance of the rope during its unwinding process can be ensured, because the material and shape of the guide collar can be optimized for the purpose of rope guidance independently of the material and shape of the side plate.

In a preferred embodiment, the side plate and the guide collar are made of different materials. Thereby, the material properties of the surface guiding the rope are not limited to be the same as those of the side plate.

In a preferred embodiment, the side plate is made of wood-based plate material, most preferably of fiberboard or plywood. Wood is a cheap and ecological choice of material, but without the collar its edges could in time get splintered or sharpen so that the rope sliding against it would be damaged.

In a preferred embodiment, the guide collar is made of polymer material, such as plastic or rubber. Said plastic is preferably Polyethylene or Polytetrafluoroethylene (PTFE).

In a preferred embodiment, the guide opening is circular. Then, the internal edge of the guide collar is circular and serves as a circular guide edge for the rope, any point of which circular internal edge (along its circumference) can guide the rope. Preferably, the circular guide opening is positioned coaxially with the rope reel.

In a preferred embodiment, the guide collar is flexible. More specifically, the guide collar is flexible such that it can flex under the pressure of the rope resting against it. Thereby, contact between the rope and the guide collar is made very gentle, because the guide collar can adapt to changes of pressure exerted on it by the rope. Thus, peaks of contact pressure between the rope and the guide collar can be smoothened, which reduces likelihood of excessive friction between those two.

Preferably, the guide collar has a flexible lip forming the internal edge of the guide collar and delimiting said guide opening.

In a preferred embodiment, the guide collar, in particular the flexible lip thereof, is flexible in axial direction of the rope reel. Then, the lip can flex such that the tip thereof moves outwards from the central space.

In a preferred embodiment, the guide collar is a flange, which is substantially flat in axial direction of the rope reel.

In a preferred embodiment, the rope is belt-shaped, and the rope is wound in said spiral form by bending it around an axis extending in width-direction of the rope. Thus, the rope settles easily in the spiral form and formation of twist can be avoided.

In a preferred embodiment, the rope is under substantial bending tension in said spiral form.

In a preferred embodiment, the rope is a rod having a straight form when in rest state and elastically bendable away from the straight form, the rope being under substantial bending tension in said spiral form.

In a preferred embodiment, the outer rim of the rope reel radially compresses against structures surrounding it radially as an effect of said bending tension. Said structures surrounding the rope reel are arranged to delimit the radius of the rope reel from expanding, and thereby to block the rope of the reel from straightening.

In a preferred embodiment, the rope is wound in a spiral form with several rope rounds, including at least an outermost rope round having an outer rim radially compressing against said structures surrounding the rope reel radially as an effect of said bending tension, as well as several inner rope rounds each having an outer rim radially compressing, as an effect of said bending tension, against the inner rim of the rope round next to it in radial direction.

In a preferred embodiment, the support body comprises one or more support members delimiting said inner space and surrounding radially said rope reel.

In a preferred embodiment, said rope comprises one or more load bearing members embedded in a polymer coating forming the surface of the rope. The collar is in this case advantageous for protecting the coating from damages. The coating may be made of elastomer, such as polyurethane.

In a preferred embodiment, the opening of the collar is smaller than the central space as measured in radial direction of the rope reel. When the opening is large, the rope can be guided through it with only minor amount of twist. The large size of the opening also alleviates wear and other friction-related problems as the frictional contact is distributed along a vaster area. For ropes suitable for elevator use, it is preferable that the diameter of the opening is at least 30 cm. Most preferably, the diameter of the opening is in the range from 30 to 100 cm.

In a preferred embodiment, said structures surrounding the rope reel radially are in supporting contact with the outer rim of the rope reel along at least majority of the rim of the rope reel.

In a preferred embodiment, the support body comprises a support shaft via which the rope storage unit can be rotatably mounted.

In a preferred embodiment, the rope is wound in a spiral form with several rope rounds, including at least a radially outermost rope round, and a radially innermost rope round, the rope being unwindable round by round starting from the innermost rope round.

In a preferred embodiment, the rope is wound in a spiral form with several rope rounds, intermediate rope rounds between the innermost and outermost rope rounds, the intermediate rounds radially compressing against the next outer round as an effect of said bending tension.

It is also brought forward a new method for installing an elevator rope, comprising the steps of providing a rope storage unit as described anywhere above; and unwinding the rope from the rope storage unit; and connecting the rope to one or more movable elevator units, said units including at least an elevator car and preferably also a counterweight.

In a preferred embodiment, the rope is wound in a spiral form with several rope rounds, including at least an radially outermost rope round, and a radially innermost rope round, and in said unwinding the rope is unwound round by round starting from the innermost rope round.

In a preferred embodiment, said unwinding comprises moving rope away from the rope reel via said central space and through the opening of the guide collar such that it slides against the surface of the collar.

In a preferred embodiment, said unwinding comprises rotating the support body.

In a preferred embodiment said rope comprises one or more load bearing members made of composite material comprising reinforcing fibers embedded in polymer matrix. This kind of structure facilitates good load supporting properties, but also requires a great force to bend the rope into spiral form, which causes a great bending tension. Thereby, the storing solution as disclosed is especially advantageous with this rope. Said reinforcing fibers are preferably carbon fibers. These fibers facilitate rope lightness and tensile stiffness, thereby making the rope well suitable for elevator use. In this case especially, a great force to bend the rope into spiral form is required. Thereby, the disclosed solution alleviating challenges in storing and installation is especially advantageous with this rope.

In a preferred embodiment the rope reel is formed by the rope wound in a two-dimensional spiral form.

In a preferred embodiment that the rope reel is formed by the rope wound in a three-dimensional spiral form.

In a preferred embodiment each of said load bearing member(s) has width larger than thickness thereof as measured in width-direction of the rope.

In a preferred embodiment, said rope comprises one or more load bearing members extending parallel to the longitudinal direction of the rope unbroken throughout the length of the rope, which one or more load bearing members is/are made of composite material comprising reinforcing fibers in polymer matrix, said reinforcing fibers preferably being carbon fibers. Said reinforcing fibers are preferably carbon fibers due to their excellent properties in elevator use, but alternatively some also other fibers could be used, such as glass fibers. With carbon fibers, the tendency to straighten is particularly strong, whereby in this context the measures for alleviating the problems of straightening of rope during installation are particularly advantageous. It is preferable that also said reinforcing fibers are parallel with the length direction of the rope. The straight structure facilitates further the longitudinal stiffness of the rope, but increases bending rigidity, whereby a great force to bend the rope into spiral form is required. Thereby, the disclosed solution alleviating challenges in storing and installation is especially advantageous with this kind of rope.

In a preferred embodiment, the reinforcing fibers of each load bearing member are distributed in the polymer matrix of the load bearing member in question and bound together by it. The reinforcing fibers of each load bearing member are then preferably substantially evenly distributed in the polymer matrix of the load bearing member in question. Furthermore, preferably, over 50% of the cross-sectional square area of the load bearing member consists of said reinforcing fibers. Thereby, a high tensile stiffness can be facilitated. Preferably, the load bearing members cover together over proportion 50% of the cross-section of the rope.

In a preferred embodiment, the module of elasticity E of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life. With this kind of material of the load bearing members, the tendency to straighten is particularly strong, whereby in this context the measures for alleviating the problems of straightening of rope during storing and installation are particularly advantageous.

In a preferred embodiment the load bearing member(s) of the rope cover(s) majority, preferably 70% or over, more preferably 75% or over, most preferably 80% or over, most preferably 85% or over, of the width of the cross-section of the rope. In this way at least majority of the width of the rope will be effectively utilized and the rope can be formed to be light and thin in the bending direction for reducing the bending tension.

The rope storage unit is preferably a movable storage unit so that the rope can be transported within the rope storage unit to an installation site of an elevator, for instance. Preferably the rope storage unit is of a size and weight transportable with a fork lift.

The elevator described anywhere above is preferably an elevator for transporting passengers and/or goods. For this purpose, it comprises a car arranged to serve two or more landings. The car preferably is arranged to respond to calls from landing(s) and/or destination commands from inside the car so as to serve persons on the landing(s) and/or inside the elevator car.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
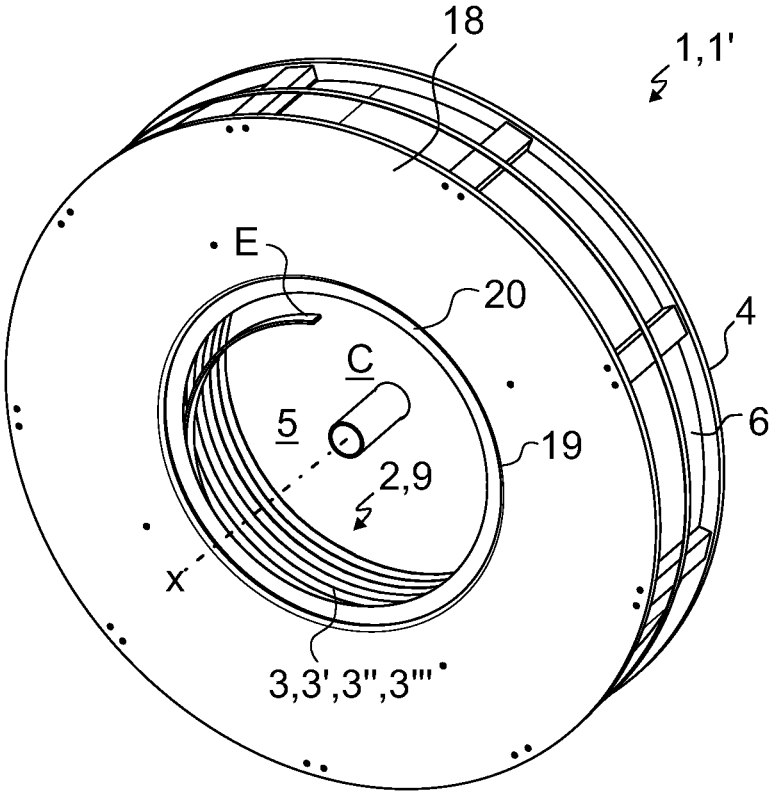
FIG. 1 illustrates a rope storage unit according to an embodiment.

FIG. 1 illustrates an embodiment of a rope storage unit 1,1'. The rope storage unit 1,1' comprises a rope reel 2,9 formed by a rope 3,3',3",3'" wound in a spiral form and having a central axis x, and delimiting a central space C inside the rope reel 2,9. The rope 3,3',3",3'" has two ends, i.e. a first end and a second end. The rope 3,3',3",3'" has been wound in a spiral form such that one end E of its two ends protrudes from the inner rim of the rope reel 2,9 into the central space C. The rope storage unit 1, 1' further comprises a support body 4 provided with an inner space 5 inside which the rope reel 2,9 is positioned supported by the support body 4. The support body 4 comprises a side face plate 18, which side face plate 18 delimits the inner space 5 in axial direction of the rope reel 2,9 and comprises an opening 19 extending through it. The rope storage unit 1,1' further comprises a guide collar 20 mounted on the side plate 18 to border the opening 19 thereof for guiding the rope end E away from the central space C, and thereby away from the inside space 5, without contacting the side face plate 18. The central space C is free such that rope 3,3',3",3'" can pass via it and through the opening 21. The material and shape of the guide collar 20 can be optimized for the purpose of rope guidance independently of the material of the side plate 18. The guide collar 20 can be made of material different than the material of the side plate 18, whereby the material properties thereof are not limited to be the same as those of the side plate 18. Also, the shape of the collar 20 can be chosen optimally for the purpose of rope guidance. Most preferably, the guide collar 20 is made of polymer material, such as plastic or rubber, whereby it has at least mediocre softness and friction properties, and it is simple to manufacture with a suitable shape and specific material properties that can be simply fine-tuned to serve the purpose. The guide collar 20 delimits a guide opening 21 that leads away from the central space C of the rope reel 2,9, and thereby away from the inside space 5 as well. The rope 3,3',3",3'" is thereby unwindable by moving it away from the rope reel 2, 9 via said central space C and through the opening 21 of the guide collar 20 such that the lateral side of the rope slides against the surface of the collar 20. The guide collar 20 provides an edge part for the opening 19 whereto the rope can lean on when moving away from the rope storage unit 1,1'. More specifically, the guide collar 20 has an internal edge delimiting the guide opening 21, which internal edge serves as a guide edge for the rope, any point of which internal edge can guide the rope 3,3',3",3'". Owing to the guide collar 20 being made of polymer material, gentleness of the contact is facilitated. Thus, the guide collar 20 serves as a gentle guide means for the rope, while the material of the side plate 18 can be chosen separately and thereby independently of requirements related to the guidance of the rope. For example, the guide collar 20 enables use of wood-based material as the material for the side plate 18, which is a cheap and ecological choice, but which could, without the collar 20, damage the rope 3,3',3",3'" due to occasional cuts by the edge of the opening 19. Accordingly, it is preferable that the side plate 18 is made of wood-based plate material, such as plywood or fiberboard, as made possible by the collar 20. In case said wood based plate material is fiberboard, it is preferably particle board, medium-density fiberboard, or hardboard.

The guide opening 21 defined by the internal edge of the guide collar 20 is preferably circular, as made visible in the preferred embodiment of FIG. 1. Thereby, the circular internal edge serves as a circular guide edge for the rope, any point (along the circumference) of which circular internal edge can guide the rope. Therefore, the contact point between the rope and the circular internal edge can rotate full circles. As a result, the rope can be rotated unobstructed in circles along the circular internal edge. Thus, rope 3,3', 3",3'" can be unwinded by rotating the storage unit 1,1', which is advantageous for unwinding of the rope efficiently without causing twist in the rope 3,3',3",3'". This is critically advantageous particularly when the rope 3,3',3",3'" is belt-shaped, because then the rope must be installed totally free of twist. Furthermore, the guide opening 21 is positioned coaxially with the rope reel 2, 9, whereby the circular internal edge is symmetrical relative to the rope reel 2,9, whereby fluent passage of rope 3,3',3",3'" during unwinding is facilitated.

Figure 2:
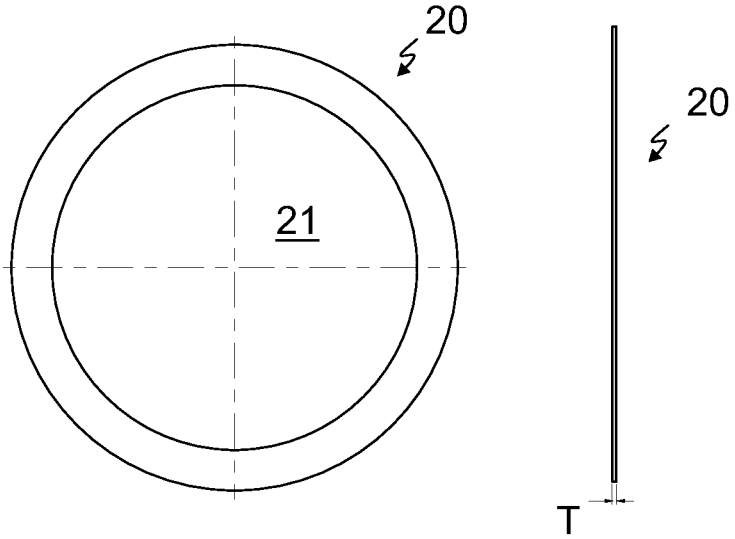
FIG. 2 illustrates a preferred structure for the guide collar.
Figure 3A:
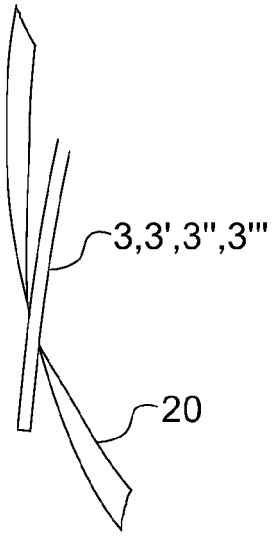
FIGS. 3*a* and 3*b* illustrate the guide collar under pressure of the rope in an embodiment where the guide collar is flexible.
Figure 3B:
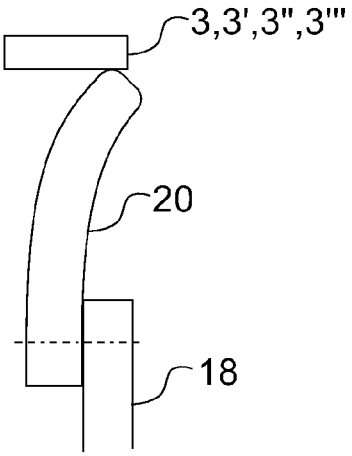

FIG. 2 discloses a preferred embodiment for the guide collar 20. In this preferred embodiment, the guide collar 20 is made flexible such that it can flex under the pressure of the rope resting against it. Thereby, contact between the rope and the guide collar 20 is made even more gentle, because the guide collar 20 can adapt to changes of pressure exerted on it by the rope. Thus, peaks of contact pressure between the rope and the guide collar 20 can be smoothened, which reduces likelihood of excessive friction between those two. FIGS. 3*a* and 3*b* illustrate how the collar 20 flexes under the pressure of the rope resting against it. The flexibility is implemented simply by choosing the material and the shape for the guide collar so that the flexibility is achieved. For the purpose of flexibility polymer material, plastic or rubber are each a suitable choice for the material of the collar 20. The structure of the guide collar 20 is preferably more specifically such that it comprises a flexible circular lip forming the internal edge of the collar 20, and thereby defines said circular guide opening 21. The lip can flex under the pressure of the rope resting against it. Said flexibility is preferably realized in axial direction of the rope reel 2, 9, as this can be easily provided for. Accordingly, the flexible lip of the guide collar 20, is flexible in axial direction of the rope reel 2, 9. The lip can then flex such that the tip thereof, i.e. the part of the lip that is closest to the center of the opening, moves outwards from the central space C. Thus, the collar 20 adapts under the pressure of the rope. Flexing enables contact surface area to be large. Thereby, it is ensured that the rope passage is fluent and neither the rope nor the collar 20 gets damaged. As illustrated in FIG. 2 it the guide collar is in this case a flange substantially flat in axial direction of the rope reel 2, 9. Thereby, it is simple to manufacture and provide with flexibility as desired. The flange has preferably thickness from 5 to 20 mm, most preferably from 10 to 20 mm as this has been noticed to serve well with elevators ropes.

The material of the collar 20 is preferably such that the rope 3,3',3",3'" can easily slide against the collar 20 without wear caused on either of them. For this end, polymer material, such as plastic or rubber is particularly suitable choice for the material of the collar 20. However, for making the contact between the rope 3,3',3",3'" and the collar 20 even more gentle, it is preferable that the friction between the collar 20 and the 3,3',3",3'" is designed to be low. Thereby, risks of rope damage can be further reduced. Low friction additionally reduces resistance caused by the collar 20, which is also advantageous, because thereby the unwinding is fluent and unvolatile. Low friction is particularly advantageous for achieving fluent and unvolatile unwinding when the rope 3,3',3",3'" has a high-friction surface coating, such as a coating made of elastomer. This is because with high-friction coating the rope 3,3',3",3'" could grip the collar 20 such that it momentarily stops, which would cause pulsation and disturb the unwinding. The low friction can be provided by choosing the material of the collar to be low-friction material. Then, plastic is particularly suitable choice for the material of the collar 20.

Low friction adequate for most cases can be provided by Polyethylene. The friction can minimalized with Polytetrafluoroethylene (PTFE), also known as Teflon™. There are of course numerous other known plastics commercially available that can be used as an alternative to the ones mentioned.

The rope is preferably a belt-like rope. Thereby, the rope 3,3',3",3'" has width substantially larger than thickness thereof in transverse direction of the rope 3,3',3",3'". Then, the rope 3,3',3",3'" is wound in said spiral form by bending it around an axis extending in width-direction of the rope 3,3',3",3'". Thus, the rope 3,3',3",3'" settles easily in the spiral form. Due to the belt-like construction, the rope also resists bending towards axial direction of the rope reel 2,9, whereby it maintains well its spiral reel configuration and is not prone to unwind accidentally. When the belt is wound in the defined way, formation of twist within the rope reel or during unwinding can also be easily avoided, which is essential for a belt-like rope.

Figure 4:
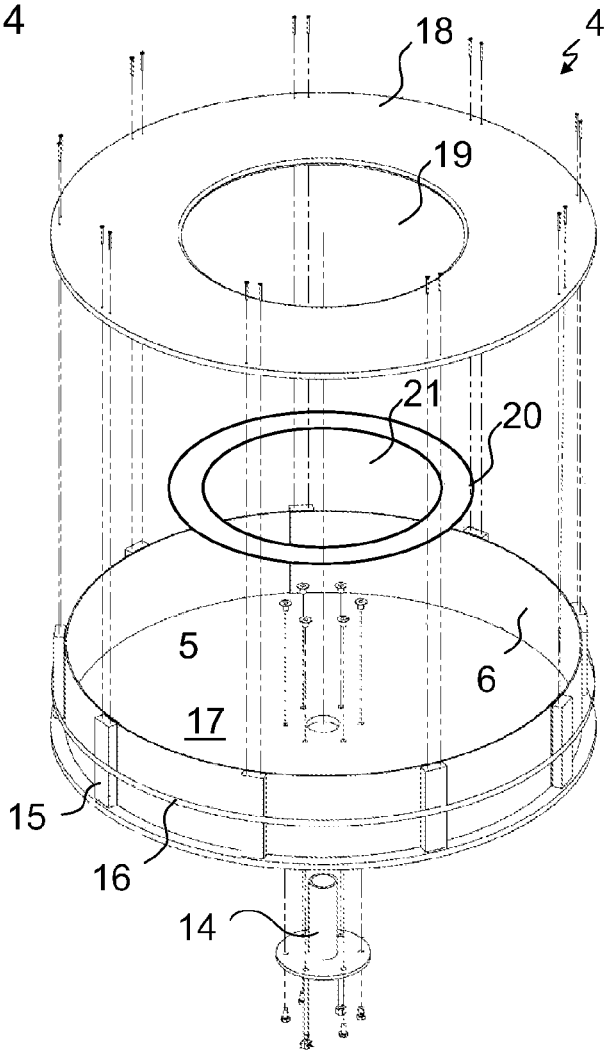
FIG. 4 illustrates an exploded view of the rope storage unit of FIG. 1 without the rope.

FIG. 4 illustrates (as an exploded view) further preferable details for the rope storage unit 1,1'. The rope storage unit 1,1' comprises said support body 4. This comprises one or more support members 6 (here two pieces) delimiting said inner space 5 and surrounding radially each rope reel 2,9 positioned inside the inner space 5. The support body 4 further comprises a support shaft 14 via which the rope storage unit 1,1' can be rotatably mounted. In the assembled state the support shaft 14 is positioned within the central space C inside the rope reel 2,9, coaxially with the rope reel 2,9. The support body 4 is in this case constructed such that it further comprises a tightening band 15 surrounding the support members 6. In this way, the structure of the support body 4 is protected from distorting during transport for instance, as well as during rope installation. In this case, there are furthermore support rods between the band 15 and the support member 6. The support body 4 further comprises two axial side plates 17, 18 delimiting the inner space 5, one of which side plates 17,18 is provided with said collar 20. The support body 4 preferably comprises a support drum formed by said one or more support members 6, which support drum delimits the inner space 5, which is in this case cylindrical. The support members 6 are in the preferred embodiment bent wood based members (e.g. plywood or fiberboard). The one or more support members 6 is/are bent into curved shape such that the support member(s) (said one or several together) form said drum. The curved form is an arc form providing an inner radius of curvature for the support member(s) 6, which corresponds to that of the outer radius of the rope reel 2 radially compressing against the one or more support members 6.

In general, it is preferable that the rope is under bending tension when wound in the spiral form. In this case, the defined configuration is particularly preferable because the rope can be unwound starting from the innermost rope rounds. The rope 3,3',3",3'" can be unwound so that each round of the rope 3,3',3",3'" still unwound and remaining on the rope reel 2,9 stays tensioned against the next outer round, the outermost round staying tensioned against said support member(s) 6, 6'. Thus, the bending tension cannot cause the rope end E to break away such that the unwinding starts to self-progress in an uncontrolled manner. As will be later explained, it is preferable that the rope 3,3',3",3'" is, more specifically, a rod having a straight form when in rest state and elastically bendable away from the straight form, the rope 3,3',3",3'" being under substantial bending tension in said spiral form. In rest state no external force is exerted on the rope 3,3',3",3'", whereby the rope 3,3',3",3'" as specified returns back to its original form after being bent owing to tension produced in the rope 3,3',3",3'" in said bending.

Figure 5:
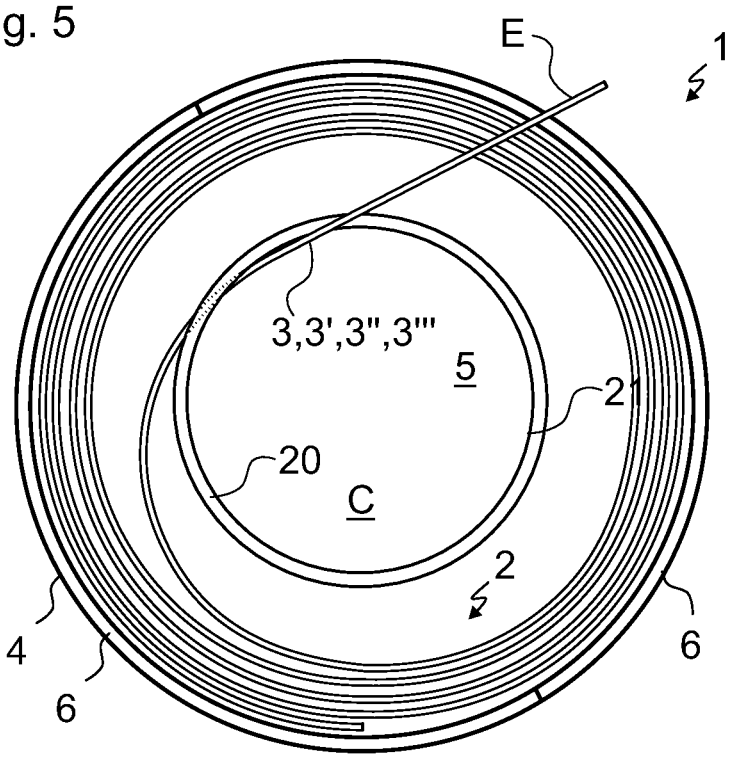
FIG. 5 illustrates guidance of the rope by the guide collar as well as further preferable details for the rope storage unit, the side plate being made invisible and the rope storage unit storing a single rope.
Figure 6:
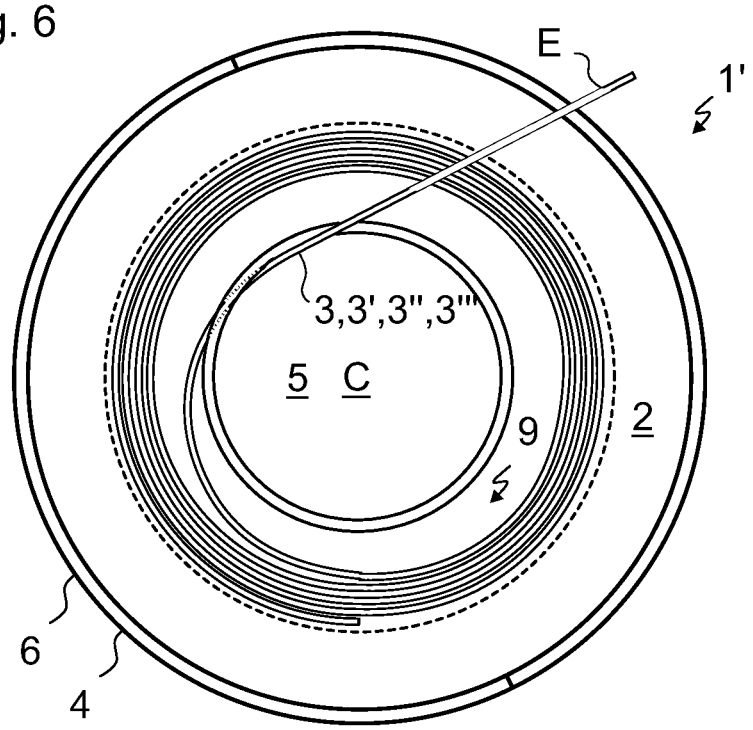
FIG. 6 illustrates guidance of the rope by the guide collar as well as further preferable details for the rope storage unit, the side plate being made invisible and the rope storage unit storing two ropes.
Figure 7A:
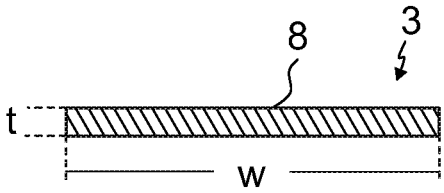
FIGS. 7*a*-7*d* illustrate preferred alternative details for the rope.
Figure 7B:
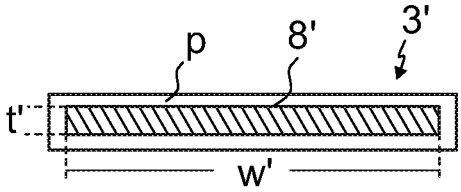
Figure 7C:
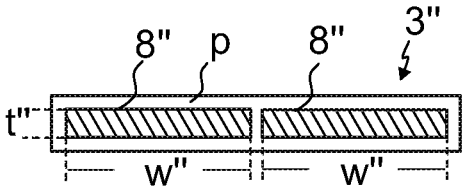
Figure 7D:
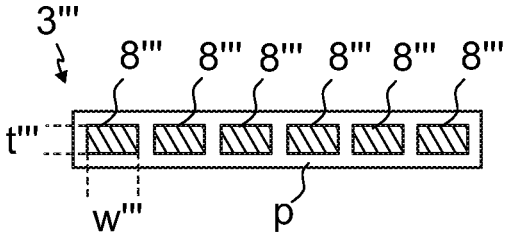

In FIGS. 5 and 6, it is illustrated how the rope is guided by the guide collar 20. The rope storage unit 1,1' is further such that the outer rim of the rope reel 2,9 radially compresses against structures 6,2 surrounding the rope reel 2,9 radially as an effect of said bending tension. Said structures 6,2 surrounding the rope reel 2,9 are arranged to delimit the radius of the rope reel 2,9 from expanding, and thereby to block the rope of the reel 2,9 from straightening. FIG. 5 illustrates an embodiment, wherein there is only one rope reel 2 in the rope storage unit 1 and FIG. 6 illustrates an embodiment, wherein there are two rope reels 2 and 9 in the rope storage unit 1', that is there is a rope reel 2 similar as illustrated in FIG. 5, as well as a rope reel 9 placed inside the central space of the rope reel 2. The inner rim of the rope reel 2 is illustrated with a broken line in FIG. 6. In each embodiment, for the rope reel 2, said surrounding structure is the support body 4. For the rope reel 9 of FIG. 6, on the other hand, the surrounding structure is the rope reel 2, or alternatively intermediate support elements, such as an intermediate padding, mounted between the rope reels 2 and 9 (not shown). In each case, the rope 3,3',3",3'" is wound in a spiral form with several rope rounds, including at least an outermost rope round having an outer rim radially compressing against the aforementioned structures 6,2 surrounding the rope reel 2,9 in question radially as an effect of said bending tension, as well as several inner rope rounds each having an outer rim radially compressing, as an effect of said bending tension, against the inner rim of the rope round next to it in radial direction.

The rope reel 2,9 is in the illustrated embodiments formed by the rope 3,3',3",3'" wound in a two-dimensional spiral form, so substantially all the rope rounds are on the same plane. This is advantageous as in this way such tension in the rope reel, which tries to twist the rope in a manner difficult to control, can be minimized. Alternatively, the rope reel 2,9 can be formed by the rope 3,3',3",3'" wound in a three-dimensional spiral form whereby substantially all the rope rounds are not on a same plane and the rope rounds pass in a slight angle relative to radial plane of the rope reel back and forth in axial direction as it is commonly known in the field of winding rope reels or corresponding reels.

Preferred alternatives for the cross section of the rope 3,3',3",3'" are presented in FIGS. 7*a* to 7*d*. As shown, the rope is belt-shaped. Thereby, the rope suits well to be stored in bent form as the radius of the rope storage unit can be made reasonable even with very rigid ropes. In the preferred embodiments of FIGS. 7*a* to 7*d*, the rope 3,3',3",3'" comprises one or more load bearing members 8, 8', 8", 8'" that are each elongated in the length direction of the rope 3,3',3",3'" and extend unbroken throughout the length of the rope 3,3',3",3'".

As for the material, the rope 3,3',3",3'" is furthermore preferably such that the load bearing members 8, 8', 8", 8'" thereof are made of composite material comprising reinforcing fibers f in polymer matrix m. This kind of rope when wound in spiral form is normally under substantial bending tension. Accordingly, handling the end E of the rope is challenging. Thereby, with the rope storage unit 1,1' challenges appearing with this kind of ropes can be alleviated particularly efficiently.

Preferably, the reinforcing fibers f are carbon fibers. Thus a light rope with high tensile stiffness can be obtained, which makes it well suitable for elevator use. Said load bearing member(s) 8, 8', 8", 8'" is/are parallel with the length direction of the rope. Said load bearing member(s) 8, 8', 8", 8'" as well as the reinforcing fibers f are preferably parallel with the length direction of the rope so the tensile stiffness can be maximized. The rope produced by this kind of structure is indeed stiff under longitudinal tension, but as a side effect, it is also rigid under bending. In particular, it is a rod having a straight form when in rest state, and it is elastically bendable away from the straight form. Owing to the elasticity of the bending, the rope self-reverses back to straight form from bent form after the external forces are released. Due to the rigidity and elasticity of the behavior in bending, handling the end E of the rope of this type is particularly challenging. Thus, improvements provided by the rope storage unit 1,1' are of particular importance.

It is preferable that each of said load bearing member(s) 8, 8', 8", 8'" has width w,w',w",w'" larger than thickness t,t',t",t'" thereof as measured in width-direction of the rope 3,3',3",3'", as illustrated. In this way a large cross-sectional area for the load bearing member/parts 3,3',3",3'" is achieved, without weakening the bending capacity around an axis extending in the width direction of the rope 3,3',3", 3'". A small number of wide load bearing members comprised in the rope leads to efficient utilization of the width of the rope, thus making it possible to keep the rope width of the rope in advantageous limits.

Each rope 3, 3' as illustrated in FIGS. 3*a* and 3*b* comprises only one load bearing member 8,8'. Each rope 3",3'" as illustrated in FIGS. 3*c* and 3*d* comprises a plurality of load bearing members 8",8'". The load bearing members 8",8" are adjacent in width-direction of the rope 3",3'". They are parallel in length direction of the rope and coplanarly positioned. Thus the resistance to bending in their thickness direction is small. The preferred internal structure for an individual load bearing member(s) 8, 8',8",8'" is disclosed elsewhere in this application, in particular in connection with FIG. 8.

The load bearing members 8',8",8" of each rope presented in FIGS. 3*b* to 3*d* is/are surrounded with a polymer coating p in which the load bearing members 8',8",8" are embedded. It provides the surface for contacting a drive wheel of the elevator, for instance. Coating p is preferably of polymer-material, most preferably of an elastomer, most preferably of polyurethane, and forms the surface of the rope 3',3",3'". It enhances effectively the ropes frictional engagement to the drive wheel 3 and protects the rope. For facilitating the formation of the load bearing member 8, 8', 8", 8'" and for achieving constant properties in the length direction it is preferred that the structure of the load bearing member 8, 8' continues essentially the same for the whole length of the rope 3,3',3",3'". The load bearing member 8 can be without a coating as presented in FIG. 3*a*. Thereby, the load bearing member may form as such the rope 3.

As mentioned, the rope 3,3',3",3'" is belt-shaped, particularly having two wide sides opposite each other. The width/thickness ratio of the rope is preferably at least at least 4, more preferably at least 5 or more, even more preferably at least 6. In this way a large cross-sectional area for the rope is achieved, the bending capacity around the width-directional axis being good also with rigid materials of the load bearing member. Thereby, the rope 3,3',3",3'" suits well to be positioned in the rope support body 4 in bent form, as well as be used for suspending an elevator car.

The rope 3,3',3",3'" is furthermore such that the aforementioned load bearing member 8 or the plurality of load bearing members 8', 8", 8'" comprised in the rope 3,3',3",3'" together cover majority, preferably 70% or over, more preferably 75% or over, most preferably 80% or over, most preferably 85% or over, of the width of the cross-section of the rope 3,3',3",3'" for essentially the whole length of the rope 3,3',3",3'". Thus the supporting capacity of the rope with respect to its total lateral dimensions is good, and the rope 3,3',3",3'" does not need to be formed to be thick. This can be simply implemented with the composite as specified elsewhere in the application and this is particularly advantageous from the standpoint of, among other things, service life and bending rigidity in elevator use. The width of the rope 3,3',3",3'" is thus also minimized by utilizing their width efficiently with wide load bearing member and using composite material. Individual belt-like ropes and the bundle they form can in this way be formed compact.

Figure 8:
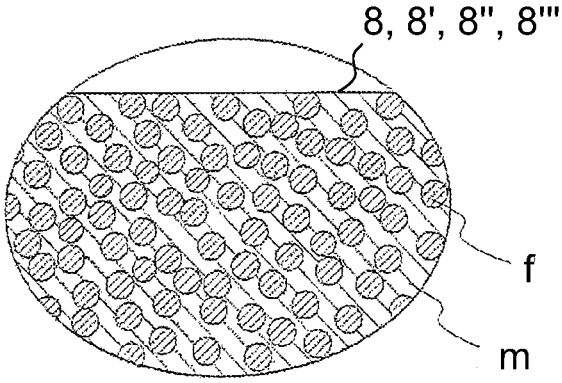
FIG. 8 illustrates a preferred internal structure of the load bearing member(s) of the rope.

The inner structure of the load bearing member 8, 8',8",8'" is more specifically as illustrated in FIG. 8 and described in the following. The load bearing member 8, 8',8",8'" as well as its fibers f are oriented in length direction of the rope, i.e. parallel with the length direction of the rope, for which reason the rope retains its structure when bending. Individual fibers are thus oriented in the length direction of the rope. In this case the fibers f are aligned with the force when the rope is pulled in its length direction. Individual reinforcing fibers f are bound into a uniform load bearing member with the polymer matrix m in which they are embedded. Thus, each load bearing member 8, 8',8",8'" is one solid elongated rodlike piece. The reinforcing fibers f are preferably long continuous fibers in the length direction of the rope 3,3',3",3'" and the fibers f preferably continue for the distance of the whole length of the rope 3,3',3",3'". Preferably as many fibers f as possible, most preferably essentially all the fibers f of the load bearing member 8, 8',8",8'" are oriented in length direction of the rope. The reinforcing fibers f are in this case essentially untwisted in relation to each other. Thus the structure of the load bearing member can be made to continue the same as far as possible in terms of its cross-section for the whole length of the rope. The reinforcing fibers f are preferably distributed in the aforementioned load bearing member 8, 8',8",8'" as evenly as possible, so that the load bearing member 8, 8',8",8'" would be as homogeneous as possible in the transverse direction of the rope. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong enough to give solid support for the fibers f. Alternatively, e.g. polyester or vinyl ester, or even some other material, can be used. FIG. 8 presents a partial cross-section of the surface structure of the load bearing member 8, 8',8",8'" as viewed in the length direction of the rope, presented inside the circle in the figure, according to which cross-section the reinforcing fibers f of the load bearing members 8, 8',8",8'" are preferably organized in the polymer matrix m. FIG. 8 presents how the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by immersing them together in the molten material of the polymer matrix. In this case the gaps of individual reinforcing fibers bound to each other with the polymer matrix comprise the polymer of the matrix. In this way a great number of reinforcing fibers bound to each other in the length direction of the rope are distributed in the polymer matrix. The reinforcing fibers are preferably distributed essentially evenly in the polymer matrix such that the load bearing member is as homogeneous as possible when viewed in the direction of the cross-section of the rope. In other words, the fiber density in the cross-section of the load bearing member does not therefore vary greatly. The reinforcing fibers f together with the matrix m form a uniform load bearing member, inside which abrasive relative movement does not occur when the rope is bent. The individual reinforcing fibers of the load bearing member 8, 8',8",8'" are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention.

If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix m is immediately against the reinforcing fiber but alternatively a thin coating, e.g. a primer arranged on the surface of the reinforcing fiber in the manufacturing phase to improve chemical adhesion to the matrix m material, can be in between. Individual reinforcing fibers are distributed evenly in the load bearing member 8, 8',8",8'" such that the gaps of individual reinforcing fibers f are filled with the polymer of the matrix m. The matrix m of the load bearing member 8, 8',8",8'" is most preferably hard in its material properties.

A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix m is hard, and therefore preferably something other than an elastomer (an example of an elastomer: rubber) or something else that behaves very elastically or gives way. However, it is not necessary that the polymer matrix is of non-elastomer, e.g. if the downsides of this kind of material are deemed acceptable or irrelevant for the intended use. The most preferred materials for the matrix m are epoxy resin, polyester, phenolic plastic or vinyl ester. The polymer matrix m is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix m. Most preferably such that approx. 60% of the surface area is of reinforcing fiber and approx. 40% is of matrix m material (preferably epoxy). In this way a good longitudinal strength of the rope is achieved.

Figure 9:
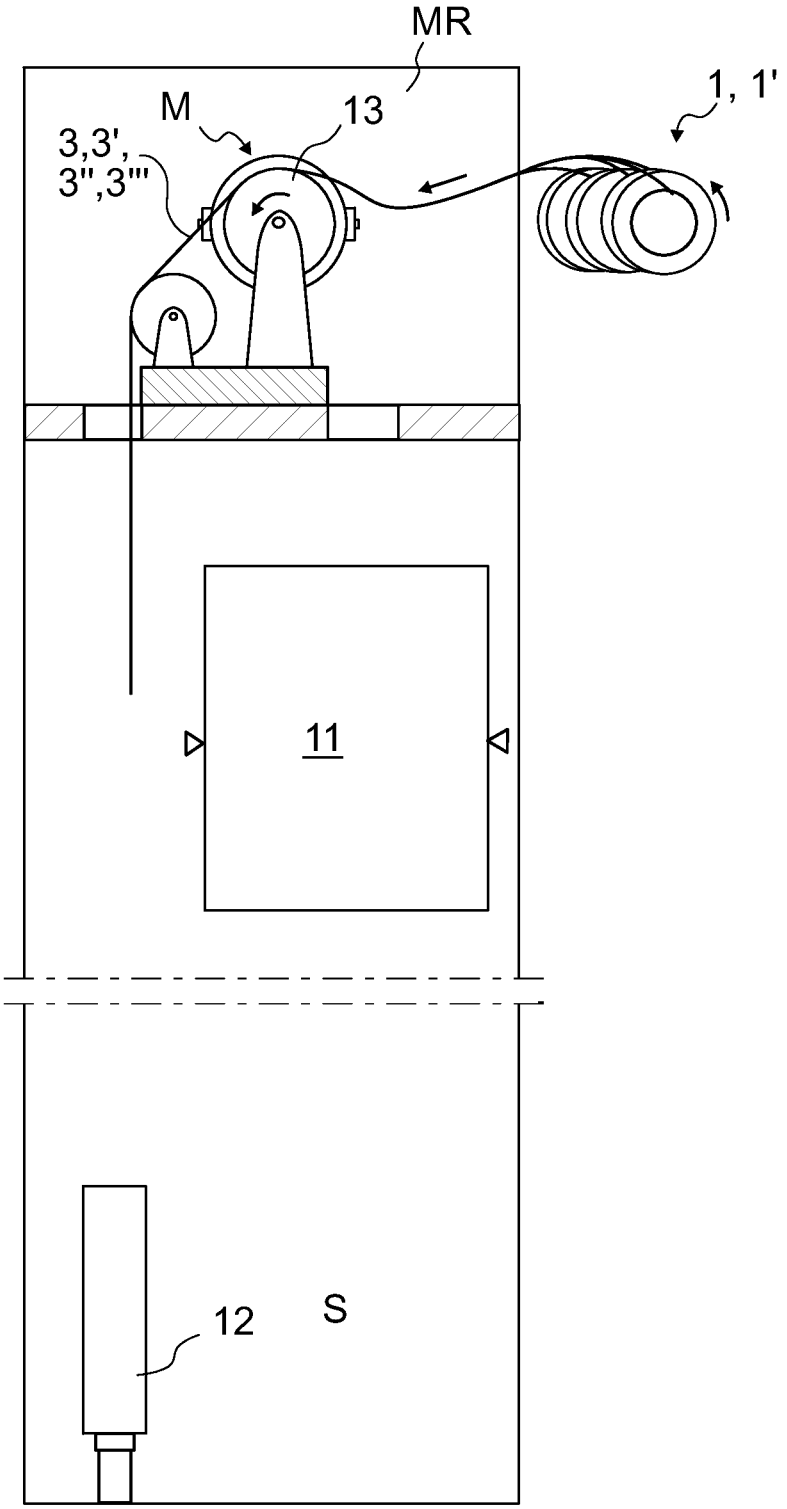
FIG. 9 illustrates an installation method.

FIG. 9 illustrates a method for installing an elevator rope according to a preferred embodiment. In the method one or more rope storage units 1, 1' are provided, which are presented elsewhere in the application. A rope 3,3',3",3''' is unwound from each rope storage unit 1, 1' as illustrated in FIG. 5 or 6, and thereafter connected to movable elevator units 11,12, i.e. to an elevator car 11 and a counterweight 12, to suspend these. In the preferred embodiment, a first end of the rope 3,3',3",3''' is connected to the car 11 and the second end to the counterweight 12. In the method a plurality of ropes 3,3',3",3''' are installed in this way simultaneously. The elevator comprises a hoistway S, an elevator car 1 and a counterweight 2 installed with the method to be vertically movable in the hoistway S. The elevator further includes a drive machine M which is arranged to drive the elevator car 1 under control of an elevator control system (not shown). During said unwinding the rope 3,3',3",3''' is guided to pass over a drive wheel 13 of the drive machine M. The drive machine M is in this embodiment mounted inside a machine room MR, but the elevator could alternatively have a machine-roomless configuration. The drive wheel 13 is arranged to engage said ropes 3,3',3",3''' passing over the drive wheel 13 and suspending the elevator car 11 and the counterweight 12. Thus, driving force can be transmitted from the motor to the car 11 and counterweight 12 via the drive wheel 13 and the ropes 3,3',3",3''' so as to move the car 11 and counterweight 12. Said unwinding comprises rotating the rope support body 4 supporting the rope reel(s) 2,9 of the rope storage unit 1,1'. Before said unwinding, the method comprises mounting the rope storage unit 1,1' rotatably (via a support shaft 14).

As elsewhere explained, the rope 3,3',3",3''' is wound in a spiral form with several rope rounds, including at least an radially outermost rope round, and a radially innermost rope round, and in said unwinding the rope is unwound round by round starting from the innermost rope round. As elsewhere explained, the rope reel 2,9 contained in the rope storage unit 1,1' delimits a central space C inside the rope reel 2,9, the rope 3,3',3",3''' having an end E protruding from the inner rim of the rope reel 2,9. As shown in FIG. 1, for instance, the rope storage unit 1,1' comprises a support body 4 provided with an inner space 5 inside which the rope reel 2,9 is positioned, the support body 4 comprising a side face plate 18), which side face plate 18 delimits the inner space 5 in axial direction of the rope reel 2,9 and comprises an opening 19 extending through it. The rope storage unit 1,1' further comprises a guide collar 20 for guiding the rope end E away from the central space C without contacting the side face plate 18), which guide collar 20 is mounted on the side plate 18 and borders the opening 19 thereof, the guide collar 20 delimiting a guide opening 21 that leads away from the central space C of the rope reel 2,9). In said unwinding rope is moved away from the rope reel 2, 9 via said central space C and through the opening 21 of the guide collar 20 such that it slides against the surface of the collar 20). As mentioned, in said unwinding the support body 4 is rotated.

The guidance of the rope away from the central space is fluent, despite changes in diameter of the reel 2,9, when the opening 21 is smaller than the central space C as measured in radial direction of the reel 2,9, as shown in FIGS. 1,5 and 6. In the embodiments where the central space C as well as the opening 21 are both circular, this means that the diameter of the opening 21 is smaller than that of the central space C. The opening 21 should, however, not be very small. When the opening 21 is large, the rope 3,3',3",3''' can be guided through it with only minor amount of twist. The large size of the opening 21 also alleviates wear and other friction-related problems as the frictional contact is distributed along a vaster area. For ropes suitable for elevator use, it is preferable that the diameter of the opening 21 is at least 30 cm. Most preferably, the diameter of the opening 21 is in the range from 30 to 100 cm.

The belt-like ropes as illustrated, have smooth surfaces. However, the ropes could be formed to have a contoured outer surface such as polyvee shapes or teeth. Even though the embodiments are most advantageous with belt-like ropes, many of the advantages would be achieved with ropes having a round cross section as well.

In this application, the term load bearing member refers to the part that is elongated in the length direction of the rope extending unbroken throughout the length of the rope. The part is able to bear without breaking a significant part of the tensile load exerted on the rope in question in the length direction of the rope. The tensile load can be transmitted inside the load bearing member all the way from its one end to the other.

As described above said reinforcing fibers f are carbon fibers. However, alternatively also other reinforcing fibers can be used. Especially, glass fibers are found to be suitable for elevator use, their advantage being that they are cheap and have good availability although a mediocre tensile stiffness and weight.

The rope storage unit and the method presented in the application is especially advantageous when the rope is a composite rope as presented. However, many of the advantages are achieved also with other kinds of ropes.

The feature that the rope is a rod having a straight form when in rest state and elastically bendable away from the straight form means that a 1.0 meter length of the straight rope 3,3',3",3''' straightens back, when released after a bending from straight form to a curved form, in which bending the rope 3,3',3",3''' is bent along its complete length to a curved form with a radius within the range of 0.3-0.5 meter. Thereby, the feature can be tested for example by bending the rope in this way It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. A rope storage unit, comprising: a rope reel including a rope wound in a spiral form having a central axis with a central space inside the rope reel, the rope having an end protruding from an inner rim of the rope reel; a support body provided with an inner space inside which the rope reel is positioned, the support body including a side face plate, the side face plate delimiting the inner space in axial direction of the rope reel, and including an opening extending through it; and a guide collar configured to guide the end of the rope away from the central space without contacting the side face plate, the guide collar mounted on the side plate and bordering the opening thereof, the guide collar including a flexible lip forming an internal edge of the guide collar and delimiting a guide opening that leads away from the central space of the rope reel.

2. The rope storage unit according to claim 1, wherein the guide collar is made of a polymer material, such as plastic or rubber.

3. The rope storage unit according to claim 2, wherein the polymer material of the guide collar includes Polyethylene or Polytetrafluoroethylene.

4. The rope storage unit according to claim 1, wherein the guide opening is circular.

5. The rope storage unit according to claim 1, wherein the guide opening is circular and positioned coaxially with the rope reel.

6. The rope storage unit according to claim 1, wherein the side plate and the guide collar are made of different materials.

7. The rope storage unit according to claim 1, wherein the side plate is made of fiberboard or plywood.

8. The rope storage unit according to claim 1, wherein the rope is belt-shaped, and the rope is wound in said spiral form by bending the rope around an axis extending in width-direction of the rope.

9. The rope storage unit according to claim 1, wherein the guide collar is flexible.

10. The rope storage unit according to claim 1, wherein the rope is under a bending tension in response to being wound in the spiral form.

11. The rope storage unit according to claim 10, wherein the outer rim of the rope reel is configured to radially compress against structures surrounding the rope reel in response to the bending tension.

12. The rope storage unit according to claim 1, wherein said rope comprises one or more load bearing members embedded in a polymer coating on a surface of the rope.

13. The rope storage unit according to claim 1, wherein said rope comprises: one or more load bearing members made of a composite material including reinforcing fibers embedded in polymer matrix, the reinforcing fibers being carbon fibers.

14. A method for installing an elevator rope using a rope storage unit, the rope storage unit including a rope reel, a support body and a guide collar, the rope reel including a rope wound in a spiral form having a central axis with a central space inside the rope reel, the rope having an end protruding from an inner rim of the rope reel, the support body provided with an inner space inside which the rope reel is positioned, the support body including a side face plate, the side face plate delimiting the inner space in axial direction of the rope reel, and including an opening extending through it, and the guide collar configured to guide the end of the rope away from the central space without contacting the side face plate, the guide collar mounted on the side plate and bordering the opening thereof, the guide collar including a flexible lip forming an internal edge of the guide collar and delimiting a guide opening that leads away from the central space of the rope reel, the method comprising: unwinding the rope from the rope storage unit ; and connecting the rope to movable elevator units, one or more of the movable elevator units each including at least an elevator car and a counterweight.

15. The method according to claim 14, wherein the rope is wound in the spiral form including at least a radially outermost rope round, and a radially innermost rope round, and wherein the unwinding comprises: unwinding the rope round by round starting from the radially innermost rope round.

16. The method according to claim 14, wherein said unwinding comprises: moving the rope away from the rope reel via said central space and through the guide opening of the guide collar such that the rope slides against a surface of the guide collar.

* * * * *